US010643771B2

(12) United States Patent
Lee et al.

(10) Patent No.: US 10,643,771 B2
(45) Date of Patent: May 5, 2020

(54) NON-ORIENTED ELECTRICAL STEEL SHEET AND MANUFACTURING METHOD THEREFOR

(71) Applicant: POSCO, Pohang-si, Gyeongsangbuk-do (KR)

(72) Inventors: Hunju Lee, Pohang-si (KR); Sang-Woo Lee, Pohang-si (KR); Su-Yong Sin, Pohang-si (KR)

(73) Assignee: POSCO, Pohang-si, Gyeongsangbuk-Do (KR)

( * ) Notice: Subject to any disclaimer, the term of this patent is extended or adjusted under 35 U.S.C. 154(b) by 408 days.

(21) Appl. No.: 15/107,900

(22) PCT Filed: Dec. 5, 2014

(86) PCT No.: PCT/KR2014/011931
§ 371 (c)(1),
(2) Date: Jun. 23, 2016

(87) PCT Pub. No.: WO2015/099315
PCT Pub. Date: Jul. 2, 2015

(65) Prior Publication Data

US 2016/0322137 A1 Nov. 3, 2016

(30) Foreign Application Priority Data

Dec. 23, 2013 (KR) ..... 10-2013-0161744

(51) Int. Cl.

| | |
|---|---|
| ***C21D 8/12*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/60*** | (2006.01) |
| ***H01F 1/147*** | (2006.01) |
| ***H01F 1/16*** | (2006.01) |

(52) U.S. Cl.

CPC ..... *H01F 1/14775* (2013.01); *C21D 8/1222* (2013.01); *C21D 8/1233* (2013.01); *C21D 8/1261* (2013.01); *C21D 8/1272* (2013.01); *C21D 9/46* (2013.01); *C22C 38/001* (2013.01); *C22C 38/002* (2013.01); *C22C 38/004* (2013.01); *C22C 38/008* (2013.01); *C22C 38/02* (2013.01); *C22C 38/04* (2013.01); *C22C 38/06* (2013.01); *C22C 38/12* (2013.01); *C22C 38/14* (2013.01); *C22C 38/60* (2013.01); *H01F 1/16* (2013.01)

(58) Field of Classification Search
None
See application file for complete search history.

(56) References Cited

U.S. PATENT DOCUMENTS

2012/0267015 A1* 10/2012 Kim ..... C21D 8/12 148/645

FOREIGN PATENT DOCUMENTS

| | | | |
|---|---|---|---|
| CN | 101466851 | A | 6/2009 |
| CN | 102634729 | B | 7/2013 |
| JP | H03-274247 | A | 12/1991 |
| JP | 08-088114 | A | 4/1996 |
| JP | H08-97023 | A | 4/1996 |
| JP | 2000-129409 | A | 5/2000 |
| JP | 2001-158948 | A | 6/2001 |
| JP | 2003-293101 | A | 10/2003 |
| JP | 2004-197217 | A | 7/2004 |
| JP | 2008-127600 | A | 6/2008 |
| JP | 2008-127612 | A | 6/2008 |
| JP | 2012-036474 | A | 2/2012 |
| JP | 2013-091837 | A | 5/2013 |
| KR | 10-2008-0027913 | A | 3/2008 |
| KR | 10-2009-0014383 | A | 2/2009 |
| KR | 10-2012-0138257 | A | 12/2012 |
| KR | 10-1329709 | B1 | 11/2013 |
| WO | 2013-146879 | A1 | 10/2013 |

OTHER PUBLICATIONS

Machine-English translation of CN 102634729 B, Liu Jie et al., Jul. 17, 2013.*
Machine-English translation of JPH03274247 A, Kaneko Teruo et al., Dec. 5, 1991.*

(Continued)

*Primary Examiner* — Colin W. Slifka
(74) *Attorney, Agent, or Firm* — Morgan, Lewis & Bockius LLP

(57) ABSTRACT

A method of manufacturing a non-oriented electrical steel sheet is disclosed. A method of manufacturing a non-oriented electrical steel sheet according to the present invention includes reheating slab consisting of Si: 2.0-4.0%, acid-soluble Al: 0.01-0.04%, Mn: 0.20% or less, Sb: 0.005-0.10%, N: 0.005% or less, S:0.005% or less, C: 0.005-0.015%, Fe in a balance amount, and other inevitable impurities in weight percent (wt %); hot rolling the slab to prepare a hot rolled steel sheet; cold rolling the hot rolled steel sheet to prepare a cold rolled steel sheet; primarily recrystallization-annealing the cold rolled steel sheet; and high-temperature annealing the cold rolled steel sheet subjected to the primarily recrystallization-annealing.

12 Claims, No Drawings

(56) References Cited

OTHER PUBLICATIONS

Korean International Search Report and Written Opinion dated Mar. 2, 2015 in International Patent Application No. PCT/KR2014/011931 (English translation).
S. K. Chang, et al. "Magnetic Anisotropies and Textures in High-alloyed Non-oriented Electrical Steels," ISIJ International, Mar. 15, 2007, vol. 47, No. 3, pp. 466-471.

* cited by examiner

NON-ORIENTED ELECTRICAL STEEL SHEET AND MANUFACTURING METHOD THEREFOR

RELATED APPLICATIONS

This application is the U.S. National Phase under 35 U.S.C. § 371 of International Application No. PCT/KR2014/011931, filed on Dec. 5, 2014, which in turn claims the benefit of Korean Patent Application No. 10-2013-0161744, filed on Dec. 23, 2013, the disclosure of which applications are incorporated by reference herein.

TECHNICAL FIELD

A non-oriented electrical steel sheet and a manufacturing method therefor are disclosed.

BACKGROUND ART

A non-oriented electrical steel sheet is mainly used for a device that converts electrical energy into mechanical energy and requires superior magnetic characteristics to achieve high efficiency.

The magnetic characteristics may include an iron loss and a magnetic flux density, when the iron loss is low, energy may be less lost during the energy conversion process, while when the magnetic flux density is high, power is more generated with small electrical energy, and accordingly, a non-oriented electrical steel sheet having a low iron loss and a high magnetic flux density may increase energy efficiency of a motor.

In particular, since a high quality non-oriented electrical steel sheet recently used to operate a motor for an environmentally-friendly vehicle is used for a high speed rotation, a high-frequency iron loss is important to reduce, and herein, the high-frequency iron loss generally indicates an iron loss at a frequency of 400 Hz or higher, and in order to reduce this high-frequency iron loss, resistivity of a material is important to increase.

The magnetic characteristics of the non-oriented electrical steel sheet may be increased by generally adding Si as an alloy element. When the resistivity is increased through the addition of Si, the high-frequency iron loss may be preferably decreased, but workability as well as the magnetic flux density may be deteriorated, and so when the Si is added in an amount of greater than or equal to 3.5%, cold-rolling may be difficult to perform.

Accordingly, an attempt to adding a resistivity increase element such as Al, Mn, and the like other than the Si has been made. The addition of these elements may reduce the iron loss but deteriorate the magnetic flux density due to their entire alloy amount increases and cause difficulties in performing the cold rolling due to increased hardness of the material and deteriorated workability. In addition, the Al and the Mn are bonded with impurities inevitably present in the steel sheet and minutely precipitate nitride, sulfide, or the like and thus may rather deteriorate the iron loss.

In order to improve the magnetic characteristics of the non-oriented electrical steel sheet, high purification of steel is also very important. The iron loss may be reduced by managing the impurities in an extremely low level during a steelmaking process and thus minimizing an inclusion in a final product. However, the high purification of steel may not significantly improve the magnetic flux density but deteriorate steelmaking workability and increase a cost.

The magnetic characteristics of the non-oriented electrical steel sheet have an influence by a texture. When the non-oriented electrical steel sheet has a texture having a high parallel orientation fraction of a {001} plane to the plate surface of the non-oriented electrical steel sheet but a low parallel orientation fraction of a {111} plane to the plate surface of crystal orientations, excellent magnetic characteristics may be obtained.

Various methods of improving the magnetic characteristics by controlling the texture have been suggested. Japanese Patent No. 2004-197217 suggested a method of growing a grain size into greater than or equal to 400 μm after hot rolled plate-annealing and then, cold-rolling and recrystallization-annealing.

Japanese Patent No. 1996-088114 suggested a method of developing an advantageous texture for magnetic characteristics through twice cold-rollings including intermediate-annealing. However, these methods of improving a texture have a problem of extremely deteriorating productivity or increasing a cost when applied to an actual manufacture process.

On the other hand, a method of improving the texture through addition of a small amount of a grain boundary segregation element has been suggested in all sorts of documents. However, the present inventor found out that the texture and the magnetic characteristics were not almost improved through an experiment of adding the element within the range provided in the documents.

DISCLOSURE

Technical Solution

An example embodiment of the present invention provides a non-oriented electrical steel sheet.

Another example embodiment of the present invention provides a method of manufacturing a non-oriented electrical steel sheet.

Technical Solution

In order to achieve the purposes, according to an example embodiment of the present invention, a non-oriented electrical steel sheet includes Si: 2.5-3.5%, Al: 0.3-1.5%, Mn: 0.3-1.5%, N: 0.001-0.005%, and S: 0.001-0.005% in weight %, one or two of Sb: 0.02-0.25%, and Sn: 0.02-0.25%, Fe in a balance amount, and other inevitable impurities, wherein contents of the Al, Mn, Sb, and Sn satisfy Equations 1 to 3.

$$0.9<([Al]+[Mn])<1.5 \quad \text{[Equation 1]}$$

$$0.05<([Sb]+[Sn])<0.25 \quad \text{[Equation 2]}$$

$$0.04<([Sb]+[Sn])/([Al]+[Mn])<0.17 \quad \text{[Equation 3]}$$

In Equations 1 to 3, [Al], [Mn], [Sb], and [Sn] refer to a weight percent (%) of each Al, Mn, Sb, and Sn.

The electrical steel sheet may have a thickness of 0.15 to 0.35 mm.

The electrical steel sheet may include composite inclusions including one or two selected from AlN and MnS, and the composite inclusions having a size of greater than or equal to 10 nm may have a distribution density of less than or equal to 0.02 unit/mm$^2$.

The electrical steel sheet may have an average grain size of 50 to 150 μm.

The electrical steel sheet may have greater than or equal to 25% of a texture fraction in which a {001} plane is parallel to the plate surface of the electrical steel sheet within 15°.

According to another preferable example embodiment of the present invention, a method of manufacturing a non-oriented electrical steel sheet includes preparing a slab including Si: 2.5-3.5%, Al: 0.3-1.5%, Mn: 0.3-1.5%, N: 0.001-0.005%, and S: 0.001-0.005% in weight %, one or two of Sb: 0.02-0.25% and Sn: 0.02-0.25%, Fe in a balance amount, and other inevitable impurities, wherein contents of the Al, Mn, Sb, and Sn satisfy Equations 1 to 3; reheating the slab and hot rolling the same to prepare a hot rolled steel sheet; cold rolling the hot rolled steel sheet to prepare a cold rolled steel sheet; and finish-annealing the cold rolled steel sheet.

$$0.9<([Al]+[Mn])<1.5 \quad \text{[Equation 1]}$$

$$0.05<([Sb]+[Sn])<0.25 \quad \text{[Equation 2]}$$

$$0.04<([Sb]+[Sn])/([Al]+[Mn])<0.17 \quad \text{[Equation 3]}$$

In Equations 1 to 3, [Al], [Mn], [Sb], and [Sn] refer to weight percent (%) of each Al, Mn, Sb, and Sn.

In the manufacturing method, the electrical steel sheet subjected to the finish-annealing step includes composite inclusions including one or two selected from AlN and MnS, and herein, the composite inclusions having a size of greater than or equal to 10 nm may have distribution density of less than or equal to 0.02 unit/mm$^2$.

In the manufacturing method, the electrical steel sheet may have an average grain size of 50 to 150 μm.

In the manufacturing method, the electrical steel sheet subjected to the finish-annealing step may have greater than or equal to 25% of a texture fraction in which a {001} plane is parallel to the plate surface of the electrical steel sheet within 15°.

The reheating may be performed at a temperature of 1100° C. to 1,200° C.

The hot rolling may be finished at a temperature of greater than or equal 10 to 800° C.

In the manufacturing method, the hot rolled steel sheet may be further subjected to hot rolled plate annealing.

The hot rolled plate annealing may be performed at a temperature of 850 to 1150° C.

In the manufacturing method, the cold rolled steel sheet may be 0.15 to 0.35 mm thick by applying a reduction ratio of 70 to 95%.

The finish-annealing may be performed at a temperature of 850 to 1100° C.

Advantageous Effects

According to the present invention, a non-oriented electrical steel sheet having an excellent magnetic flux density may be provided by optimizing the contents of Si, Al, Mn, Sb, Sn, and the like, decreasing a distribution density of inclusions in the steel sheet, and thus improving an iron loss and simultaneously, improving a texture fraction that a {001} plane is parallel to the plate surface of the electrical steel sheet within 15°. Accordingly, efficiency of a motor for driving an environmentally-friendly vehicle may be improved.

MODE FOR INVENTION

Merits and characteristics of the present invention, and methods for accomplishing them, will become more apparent from the following example embodiments taken in conjunction with the accompanying drawings. However, the present invention is not limited to the disclosed example embodiments, and may be implemented in various manners. The embodiments are provided to complete the disclosure of the present invention and to allow those having ordinary skill in the art to understand the scope of the present invention. The present invention is defined by the appended claims.

Hereinafter, a method of manufacturing a non-oriented electrical steel sheet according to preferable Examples of the present invention is described in detail.

A method of a non-oriented electrical steel sheet according to an example embodiment of the present invention includes Si: 2.5-3.5%, Al: 0.3-1.5%, Mn: 0.3-1.5%, N: 0.001-0.005%, and S: 0.001-0.005% in weight %, one or two of Sb: 0.02-0.25%, and Sn: 0.02-0.25%, Fe in a balance amount, and other inevitable impurities, wherein contents of the Al, Mn, Sb, and Sn satisfy Equations 1 to 3.

$$0.9<([Al]+[Mn])<1.5 \quad \text{[Equation 1]}$$

$$0.05<([Sb]+[Sn])<0.25 \quad \text{[Equation 2]}$$

$$0.04<([Sb]+[Sn])/([Al]+[Mn])<0.17 \quad \text{[Equation 3]}$$

In Equations 1 to 3, [Al], [Mn], [Sb], and [Sn] refer to weight percent (%) of each Al, Mn, Sb, and Sn.

The electrical steel sheet may have a thickness of 0.15 to 0.35 mm.

The non-oriented electrical steel sheet may have a high magnetic flux density and a low iron loss (W10/400), since composite inclusions including either AlN or MnS alone or at least one thereof are formed therein, and herein, the composite inclusions having a size of greater than or equal to 10 nm have a distribution density of 0.02 unit/mm$^2$, and the non-oriented electrical steel sheet has greater than or equal to 25% of a texture fraction that a {001} plane is parallel to the plate surface of the electrical steel sheet within 15° and an average grain size ranging from 50-150 μm. (Herein, the plate surface of the electrical steel sheet indicates a xy surface, when the rolling direction of the electrical steel sheet is an x-axis, while the width direction of the electrical steel sheet is a y-axis.)

Hereinafter, a reason of limiting the ranges of elements constituting the electrical steel sheet of the present invention and their addition ratios are illustrated.

[Si: 2.5-3.5 wt %]

Si plays a role of increasing resistivity of a material and thus decreasing an iron loss, and when added in an amount of less than 2.5%, the Si lacks of an effect of improving a high-frequency iron loss, but when added in an amount of greater than 3.5%, hardness of the material is increased, and thus productivity and punching properties are unfavorably deteriorated. Specifically, the Si may be added in an amount of 2.7-3.4 wt %.

[Al: 0.3-1.5 wt %]

Al increases resistivity of the material and thus decreases the iron loss and forms nitride. When the Al is added in an amount of less than 0.3%, there is no effect of decreasing a high-frequency iron loss, and nitride is minutely formed and thus deteriorates magnetic characteristics, but when added in an amount of 1.5%, a problem in all the processes of steelmaking, continuous casting, and the like is caused and sharply deteriorates productivity. Specifically, the Al may be included in an amount of 0.5-1.0 wt %.

[Mn: 0.1-1.5 wt %]

Mn plays a role of increasing resistivity of the material and thus improving an iron loss but forming sulfide, and when added in an amount of less than or equal to 0.3%, MnS is minutely precipitated and thus deteriorates magnetic characteristics and has almost no effect of improving a high-frequency iron loss. When the Mn is included in an amount of greater than 1.5%, the Mn promotes formation of a texture that a {111} plane disadvantageous for magnetic characteristics is parallel to the plate surface of the electrical steel sheet within 15° and thus reduces a magnetic flux density and accordingly, may be limitedly added within a range of 0.1-1.5%. Specifically, the Mn may be added in an amount of 0.1-0.7 wt %.

The [Al]+[Mn] is limitedly added in an amount of 0.9-1.5% within the Si composition range, because the [Al]+[Mn] amount of less than or equal to 0.9% may have a small effect of coarsely precipitating inclusions and a little effect of improving a high-frequency iron loss, but when the [Al]+[Mn] amount of greater than or equal to 1.5%, hardness of the material may be increased due to an increased alloy amount, and thus productivity may be deteriorated.

[N: 0.001-0.005 wt %]

N forms a minute and long AlN precipitate inside a mother material, suppresses growth of a crystal grain and deteriorates an iron loss and thus may be preferably included as little as possible, but in the present invention, since the N is limitedly diffused by a grain boundary segregation element, the content of the N is limited in an range of 0.001-0.005%. Specifically, the N may be used in an amount of 0.0021-0.0024%.

[S: 0.001-0.005 wt %]

Since S forms a fine precipitate such as MnS and CuS and deteriorates magnetic characteristics and thus should be preferably managed in a low level despite its inevitable presence in the steel sheet and then, removed through a refining process if possible during steelmaking, but the S is limitedly diffused by the grain boundary segregation element in the present invention and thus limitedly used in a range of 0.001-0.005%. Specifically, the S may be used in a range of 0.0019-0.0024%.

[Sb: 0.02-0.25 wt %]

Sb is segregated by the surface and grain boundary of the steel sheet and thus suppresses oxidation of the surface during annealing and hinders diffusion of elements through the grain boundary and recrystallization of a texture that a {111} plane is parallel to the plate surface of the electrical steel sheet within 15° and thus improves the texture. When the Sb is added in an amount of less than or equal to 0.02%, there is no effect, but when the Sb is added in an amount of greater than or equal to 0.25%, toughness is deteriorated due to its increased grain boundary segregation amount, and thus productivity is deteriorated compared with improvement of magnetic characteristics. Specifically, the Sb may be used in a range of 0.03-0.12%.

[Sn: 0.02-0.25 wt %]

Sn is segregated on the surface and grain boundary of the steel sheet and thus plays a role of suppressing oxidation of the surface during annealing, hindering diffusion of elements through the grain boundary and recrystallization of a texture that a {111} plane is parallel to the plate surface of the electrical steel sheet within 15°, and thus improving the texture. When added in an amount of less than or equal to 0.02%, there is no effect, but when added in an amount of greater than or equal to 0.25%, toughness is deteriorated due to an increased grain boundary segregation amount, and thus productivity is deteriorated compared with improvement of magnetic characteristics. Specifically, the Sn may be added in an amount of 0.03-0.12%.

([Sb]+[Sn]) are limited in a range of 0.05-0.25%, because the most excellent effect of improving magnetic characteristics is obtained within the range. When used in an amount of less than or equal to 0.05%, there is no effect of improving magnetic characteristics, but when used in an amount of greater than or equal to 0.25%, the magnetic characteristics may be rather deteriorated, and toughness of the material is also extremely deteriorated, and resultantly, there may be a productivity problem. Specifically, the ([Sb]+[Sn]) may be used in a range of 0.06-0.24%.

A ratio of ([Sb]+[Sn])/([Al]+[Mn]) is limited in a range of 0.04-0.17, the Sb and the Sn are segregated by the grain boundary within the range and hinders diffusion of the N and the S on the grain boundary and thus formation of a precipitate and suppresses formation of a texture that a {111} plane is parallel to the plate surface of the electrical steel sheet within 15° during finish-annealing and thus obtains an advantageous texture for the magnetic characteristics. When the ratio of ([Sb]+[Sn])/([Al]+[Mn]) is out of the range, the magnetic characteristics may be rather deteriorated, but an iron loss is increased. Specifically, the ratio of ([Sb]+[Sn])/([Al]+[Mn]) may be in a range of 0.05-0.16.

Such an element as C, Ti, Nb, and the like in addition to the above elements may be included. The C may cause magnetic aging and thus be limitedly used in an amount of less than or equal to 0.004% and preferably, less than or equal to 0.003%. The Ti promotes growth of a texture that a {111} plane, an unfavorable crystal orientation in the non-oriented electrical steel sheet is parallel to the plate surface of the electrical steel sheet within 15° and thus may be used in an amount of less than or equal to 0.004% and preferably, less than or equal to 0.002%.

Hereinafter, a method of manufacturing a non-oriented electrical steel sheet according to the present invention is described.

The method of manufacturing a non-oriented electrical steel sheet according to the present invention may preferably use an alloy element having high purity to minimize pick-up of impurities in a steelmaking step.

Ingot steel obtained in this way is solidified in a continuous casting process and manufactured into a slab. The slab is charged in a furnace and reheated at greater than or equal to 1100° C. and less than or equal to 1,200° C. When reheated at greater than or equal to 1200° C., a precipitate may be re-molten and minutely precipitated after hot rolling, and thus the reheating is performed at less than or equal to 1200° C.

After reheating the slab, hot rolling is subsequently performed. During the hot rolling, hot finish rolling may be performed at greater than or equal to 800° C.

The hot-rolled hot rolled plate is hot rolled plate-annealing at 850-1150° C. When the hot rolled plate annealing is performed at less than 850° C., a texture does not grow at all or minutely grows and has a small effect of increasing a magnetic flux density, but when the annealing is performed at greater than 1,150° C., magnetic characteristics may be rather deteriorated, rolling workability may be also deteriorated due to deformation of a plate shape, and thus the annealing may be performed in a range of 850-1,150° C. Preferably, the annealing of the hot rolled plate may be performed in a range of 950-1,150° C. The annealing of the hot rolled plate is performed to increase an advantageous orientation for the magnetic characteristics if necessary but may be omitted.

After performing or omitting the hot rolled plate annealing, the hot rolled plate is subsequently acid-washed and then, cold-rolled to have a predetermined thickness.

The cold rolling may provide a cold rolled plate having a thickness of less than or equal to 0.35 mm by applying a reduction ratio of about 70-95%. Specifically, the thickness may be in a range of 0.15-0.35 mm. When the thickness is less than or equal to 0.35 mm, the electrical steel sheet may have an improved high-frequency iron loss and an excellent magnetic flux density.

Herein, the reduction ratio indicates (thickness before rolling−thickness after rolling)/(thickness before rolling).

The cold-rolled plate after the cold rolling is finish-annealed. When the finish-annealing is performed at less than or equal to 850° C., recrystallization insufficiently occurs, but when the finish-annealing is performed at greater than 1100° C., a crystal grain may have too a large diameter, and the high-frequency iron loss may be deteriorated, and accordingly, the finish-annealing may be preferably performed at 850-1100° C., so that the crystal grain may have a diameter of 50-150 μm.

Hereinafter, the method of manufacturing the non-oriented electrical steel sheet according to the present invention is illustrated in detail through Examples. However, the following Examples only exemplify the present invention but do not restrict the contents of the present invention.

Example

Each steel ingot was manufactured by vacuum-melting components shown in Table 1 in a lab. Impurities in materials such as C, Ti, and Nb were all controlled to be less than or equal to 0.0025%. Each material was reheated up to 1130° C. and hot finish-rolled at 870° C. to manufacture a 2.0 mm-thick hot rolled plate. The hot-rolled hot rolled plate was hot rolled plate-annealed at 1100° C., acid-washed, and cold-rolled to have a thickness of 0.30 mm and then, finally annealed at 980° C. for 100 seconds.

TABLE 1

| Steel grade | Si | Al | Mn | Sb | Sn | N | S | C | Ti | Nb |
|---|---|---|---|---|---|---|---|---|---|---|
| A1 | 2.7 | 0.5 | 0.1 | 0.06 | 0.06 | 0.0023 | 0.0023 | 0.0019 | 0.0018 | 0.0024 |
| A2 | 2.7 | 0.5 | 0.4 | 0.03 | 0.03 | 0.0021 | 0.0021 | 0.0024 | 0.0023 | 0.0019 |
| A3 | 2.7 | 0.7 | 0.5 | 0.00 | 0.03 | 0.0022 | 0.0021 | 0.0018 | 0.0021 | 0.0020 |
| A4 | 2.7 | 0.9 | 0.5 | 0.09 | 0.09 | 0.0019 | 0.0022 | 0.0021 | 0.0021 | 0.0023 |
| A5 | 2.7 | 0.9 | 0.5 | 0.03 | 0.00 | 0.0024 | 0.0019 | 0.0021 | 0.0020 | 0.0021 |
| A6 | 2.7 | 0.9 | 0.9 | 0.06 | 0.12 | 0.0018 | 0.0024 | 0.0023 | 0.0023 | 0.0022 |
| A7 | 3.0 | 0.3 | 0.3 | 0.02 | 0.00 | 0.0023 | 0.0021 | 0.0021 | 0.0020 | 0.0024 |
| A8 | 3.0 | 0.7 | 0.5 | 0.03 | 0.06 | 0.0021 | 0.0024 | 0.0024 | 0.0023 | 0.0021 |
| A9 | 3.0 | 0.9 | 0.6 | 0.06 | 0.06 | 0.0021 | 0.0024 | 0.0021 | 0.0021 | 0.0021 |
| A10 | 3.0 | 0.9 | 0.9 | 0.03 | 0.02 | 0.0024 | 0.0021 | 0.0021 | 0.0024 | 0.0020 |
| A11 | 3.4 | 0.3 | 0.4 | 0.03 | 0.03 | 0.0019 | 0.0020 | 0.0023 | 0.0020 | 0.0023 |
| A12 | 3.4 | 0.6 | 0.4 | 0.06 | 0.03 | 0.0021 | 0.0021 | 0.0019 | 0.0023 | 0.0021 |
| A13 | 3.4 | 0.6 | 0.5 | 0.12 | 0.12 | 0.0024 | 0.0020 | 0.0019 | 0.0021 | 0.0020 |
| A14 | 3.4 | 0.6 | 0.7 | 0.03 | 0.03 | 0.0017 | 0.0024 | 0.0024 | 0.0019 | 0.0021 |
| A15 | 3.4 | 0.7 | 0.6 | 0.06 | 0.06 | 0.0017 | 0.0019 | 0.0021 | 0.0021 | 0.0021 |
| A16 | 3.4 | 0.8 | 0.1 | 0.06 | 0.06 | 0.0022 | 0.0021 | 0.0019 | 0.0021 | 0.0021 |
| A17 | 3.4 | 0.9 | 0.1 | 0.09 | 0.09 | 0.0024 | 0.0023 | 0.0021 | 0.0020 | 0.0020 |
| A18 | 3.4 | 1.0 | 0.5 | 0.12 | 0.12 | 0.0021 | 0.0021 | 0.0021 | 0.0019 | 0.0021 |
| A19 | 3.4 | 1.0 | 0.6 | 0.15 | 0.13 | 0.0020 | 0.0019 | 0.0020 | 0.0024 | 0.0020 |

The amounts and ratios of main components, an iron loss, a magnetic flux density, a distribution density of inclusions, a {001}//ND fraction (a fraction of a texture where a {001} plane is parallel to the plate surface of an electrical steel sheet within 15°) are shown in Table 2. Magnetic characteristics were calculated by measuring magnetic characteristics in a rolling direction and a perpendicular direction using a single sheet tester and averaging them. In order to examine the inclusions, a sample was manufactured by using a replica method generally used in a steel material and a transmission electron microscope. Herein, 200 kV of an acceleration voltage was applied thereto. The texture was measured by using EBSD, and the {001}//ND fraction was calculated by calculating ODF and including an orientation within an error range of 15°.

TABLE 2

| Steel grade | Al + Mn | Sb + Sn | (Sb + Sn)/(Al + Mn) | Iron loss (W10/400) | Magnetic flux density B50 | Inclusion distribution density | {001}// ND fraction | Note |
|---|---|---|---|---|---|---|---|---|
| A1 | 0.6 | 0.12 | 0.20 | 15.9 | 1.68 | 0.18 | 22 | Comparative Example |
| A2 | 0.9 | 0.06 | 0.07 | 13.8 | 1.71 | 0.01 | 28 | Example |
| A3 | 1.2 | 0.03 | 0.03 | 15.7 | 1.66 | 0.29 | 15 | Comparative Example |
| A4 | 1.4 | 0.18 | 0.13 | 13.6 | 1.70 | 0.01 | 33 | Example |
| A5 | 1.4 | 0.03 | 0.02 | 15.6 | 1.67 | 0.35 | 16 | Comparative Example |

TABLE 2-continued

| Steel grade | Al + Mn | Sb + Sn | (Sb + Sn)/(Al + Mn) | Iron loss (W10/400) | Magnetic flux density B50 | Inclusion distribution density | {001}// ND fraction | Note |
|---|---|---|---|---|---|---|---|---|
| A6 | 1.8 | 0.18 | 0.10 | 15.4 | 1.68 | 0.14 | 29 | Comparative Example |
| A7 | 0.6 | 0.02 | 0.03 | 15.8 | 1.67 | 0.32 | 14 | Comparative Example |
| A8 | 1.2 | 0.09 | 0.08 | 13.2 | 1.69 | 0.01 | 29 | Example |
| A9 | 1.5 | 0.12 | 0.08 | 13.0 | 1.69 | 0.01 | 31 | Example |
| A10 | 1.8 | 0.05 | 0.03 | 14.9 | 1.65 | 0.25 | 18 | Comparative Example |
| A11 | 0.7 | 0.06 | 0.09 | 15.4 | 1.68 | 0.17 | 28 | Comparative Example |
| A12 | 1.0 | 0.09 | 0.09 | 12.9 | 1.67 | 0.01 | 29 | Example |
| A13 | 1.1 | 0.24 | 0.22 | 14.9 | 1.66 | 0.06 | 28 | Comparative Example |
| A14 | 1.3 | 0.06 | 0.05 | 12.9 | 1.67 | 0.01 | 27 | Example |
| A15 | 1.3 | 0.12 | 0.09 | 12.9 | 1.67 | 0.01 | 31 | Example |
| A16 | 0.9 | 0.12 | 0.13 | 13.0 | 1.68 | 0.01 | 30 | Example |
| A17 | 1.0 | 0.18 | 0.18 | 14.7 | 1.66 | 0.07 | 27 | Comparative Example |
| A18 | 1.5 | 0.24 | 0.16 | 12.7 | 1.67 | 0.01 | 31 | Example |
| A19 | 1.6 | 0.28 | 0.18 | 14.6 | 1.66 | 0.05 | 29 | Comparative Example |

Referring to Table 2, as for A2, A4, A8, A9, A11, A12, A14, A15, A16, and A18 including Al+Mn, Sb+Sn, and (Sb+Sn)/(Al+Mn) within a range satisfying the present invention, the inclusions having a size of greater than or equal to 10 nm had a low distribution density of less than or equal to 0.02 unit/mm$^2$. Accordingly, the iron loss was low and simultaneously, the {001}//ND fraction was greater than or equal to 25% and thus a high magnetic flux density were obtained.

On the other hand, the steel grades A1 and A11 included Al+Mn in a less amount than the range of the present invention and thus exhibited a satisfactory magnetic flux density but a deteriorated iron loss, and the steel grades A6 and A11 included Al+Mn in a greater amount than the range of the present invention and thus exhibited an increased distribution density but a deteriorated iron loss. The steel grades A7 and A10 included Sb+Sn in a less amount than the range of the present invention and thus exhibited a deteriorated texture and a low magnetic flux density, and the steel grade A19 included Sb+Sn in a greater amount of the range of the present invention and thus exhibited a deteriorated iron loss and inferior workability.

The steel grades A13 and A17 had a higher (Sb+Sn)/(Al+Mn) ratio than the range of the present invention and thus exhibited a deteriorated iron loss and workability, and the steel grades A3 and A5 had a lower (Sb+Sn)/(Al+Mn) ratio than the range of the present invention and thus much deteriorated magnetic flux density and iron loss.

While this invention has been described in connection with what is presently considered to be practical example embodiments, it is to be understood that the invention is not limited to the disclosed embodiments, but, on the contrary, is intended to cover various modifications and equivalent arrangements included within the spirit and scope of the appended claims.

The invention claimed is:

1. A non-oriented electrical steel sheet, consisting of

Si: 2.5-3.5%, Al: 0.3% or more and less than 1.5%, Mn: 0.3% or more and less than 1.5%, N: 0.001-0.005%, S: 0.001-0.005% in weight %, Sb: 0.02-0.25% and Sn: 0.02-0.25%, Fe in a balance amount, and other inevitable impurities, wherein contents of the Al, Mn, Sb, and Sn satisfy Equations 1 to 3:

$$0.9<([Al]+[Mn])<1.5 \quad \text{[Equation 1]}$$

$$0.05<([Sb]+[Sn])<0.25 \quad \text{[Equation 2]}$$

$$0.07<([Sb]+[Sn])/([Al]+[Mn])<0.17 \quad \text{[Equation 3]}$$

wherein, in Equations 1 to 3, [Al], [Mn], [Sb], and [Sn] refer to weight percent (%) of each Al, Mn, Sb, and Sn, and wherein the non-oriented electrical steel sheet has an iron loss (W10/400) of less than 13.8.

2. The non-oriented electrical steel sheet of claim 1, wherein a thickness of the electrical steel sheet is 0.15 to 0.35 mm.

3. The non-oriented electrical steel sheet of claim 2, wherein the non-oriented electrical steel sheet includes composite inclusions comprising one or two selected from AlN and MnS, and the composite inclusions having a size of greater than or equal to 10 nm has a distribution density of less than or equal to 0.02 unit/mm$^2$.

4. The non-oriented electrical steel sheet of claim 3, wherein the electrical steel sheet has an average grain size of 50 to 150 μm.

5. The non-oriented electrical steel sheet of claim 1, wherein the non-oriented electrical steel sheet has greater than or equal to 2.9% of a texture fraction in which a {001} plane is parallel to the plate surface of the electrical steel sheet within an error range of 15°.

6. A method of manufacturing a non-oriented electrical steel sheet, comprising preparing a slab consisting of Si: 2.5-3.5%, Al: 0.3% or more and less than 1.5%, Mn: 0.3% or more and less than 1.5%, N: 0.001-0.005%, S: 0.001-0.005% in weight %, Sb: 0.02-0.25% and Sn: 0.02-0.25%, Fe in a balance amount, and other inevitable impurities, wherein contents of the Al, Mn, Sb, and Sn satisfy Equations 1 to 3;

reheating the slab and hot rolling the same to prepare a hot rolled steel sheet;

cold-rolling the hot rolled steel sheet to prepare a cold rolled steel sheet; and finish-annealing the cold rolled steel sheet:

$$0.9<([Al]+[Mn])<1.5 \quad \text{[Equation 1]}$$

$$0.05<([Sb]+[Sn])<0.25 \quad \text{[Equation 2]}$$

$$0.07<([Sb]+[Sn])/([Al]+[Mn])<0.17 \quad \text{[Equation 3]}$$

wherein, in Equations 1 to 3, [Al], [Mn], [Sb], and [Sn] refer to weight percent (%) of each Al, Mn, Sb, and Sn, and wherein the non-oriented electrical steel sheet has an iron loss (W10/400) of less than 13.8.

7. The method of claim 6, wherein the electrical steel sheet subjected to the finish-annealing step comprises composite inclusions including one or two selected from AlN and MnS, and the composite inclusions having a size of greater than or equal to 10 nm has a distribution density of less than or equal to 0.02 unit/mm$^2$.

8. The method of claim 6, wherein the slab is reheated at 1,100° C. to 1,200° C.

9. The method of claim 8, wherein the hot rolling is finished at greater than or equal to 800° C.

10. The method of claim 9, which comprises hot rolled plate-annealing the hot rolled steel sheet at 850 to 1150° C.

11. The method of claim 10, wherein the cold rolled steel sheet is 0.15 to 0.35 mm thick by applying a reduction ratio of 70 to 95%.

12. The method of claim 9, wherein the electrical steel sheet subjected to the finish-annealing step has greater than or equal to 29% of a texture fraction in which a {001} plane is parallel to the plate surface of the electrical steel sheet within an error range of 15°.

* * * * *